US011186969B2

(12) United States Patent
Mesiemore

(10) Patent No.: US 11,186,969 B2
(45) Date of Patent: Nov. 30, 2021

(54) SHOWER WATER CATCHER

(71) Applicant: Roger Glenn Mesiemore, Lake Wylie, SC (US)

(72) Inventor: Roger Glenn Mesiemore, Lake Wylie, SC (US)

( * ) Notice: Subject to any disclaimer, the term of this patent is extended or adjusted under 35 U.S.C. 154(b) by 25 days.

(21) Appl. No.: 16/704,506

(22) Filed: Dec. 5, 2019

(65) Prior Publication Data

US 2020/0181891 A1 Jun. 11, 2020

Related U.S. Application Data

(60) Provisional application No. 62/775,979, filed on Dec. 6, 2018.

(51) Int. Cl.
*E03B 1/04* (2006.01)
*A47K 3/28* (2006.01)

(52) U.S. Cl.
CPC ..... *E03B 1/048* (2013.01); *A47K 3/281* (2013.01)

(58) Field of Classification Search
CPC ..... E03B 1/048; E03C 1/0408; A47K 3/28; A47K 3/281
USPC ..... 4/605
See application file for complete search history.

(56) References Cited

U.S. PATENT DOCUMENTS

| | | | | |
|---|---|---|---|---|
| 5,140,714 | A | 8/1992 | Horenstein et al. | |
| 5,165,456 | A | 11/1992 | Woolman | |
| 5,435,022 | A * | 7/1995 | Andersen | E03C 1/00 4/641 |
| 5,862,544 | A * | 1/1999 | Placencia | E03C 1/02 4/597 |
| 9,376,788 | B1 * | 6/2016 | Turner | A47K 3/281 |
| 2010/0051107 | A1 | 3/2010 | Crawford | |
| 2013/0048104 | A1 * | 2/2013 | Li | E03B 1/048 137/386 |
| 2016/0273566 | A1 * | 9/2016 | Ortwein | C09J 5/00 |
| 2016/0360933 | A1 * | 12/2016 | Hain | F16B 7/0413 |
| 2017/0181583 | A1 * | 6/2017 | Chiu | B05B 15/62 |
| 2017/0260721 | A1 * | 9/2017 | Velez, Jr. | E03C 1/0408 |
| 2018/0202135 | A1 * | 7/2018 | Chiu | E03C 1/06 |
| 2019/0161974 | A1 * | 5/2019 | Parra | E03B 1/048 |

* cited by examiner

*Primary Examiner* — J C Jacyna
(74) *Attorney, Agent, or Firm* — Ashley Law Firm P.C.; Stephen S. Ashley, Jr.

(57) ABSTRACT

A water-saving apparatus provides a means to reduce residential shower water waste by catching open-to-touch showerhead spray water via an interior shower/tub surround-wall catch member, such as a tray, funnel or gutter, before the water contacts the shower floor during shower water startup and shower idle times, and directs the water into a holding member, such as a bucket, tank or container, so it can be later repurposed.

20 Claims, 10 Drawing Sheets

SHOWER WATER CATCHER

CROSS REFERENCE TO RELATED APPLICATIONS

This application claims priority to U.S. Provisional Patent Application No. 62/775,979, filed Dec. 6, 2018, which is incorporated by reference herein.

TECHNICAL FIELD

The present invention relates to water conservation. One embodiment of the invention comprises an apparatus adapted to be installed within a shower stall and capture preventable water-waste discharged from the showerhead.

BACKGROUND

A common practice in the daily routine of many people is to run shower water while waiting for warm water to discharge from the showerhead at the beginning of turning the shower water on. Often, a person will allow the water to continue to run while shaving or shampooing, which does not necessarily serve purposes of bathing the person's body. Typically, the first fifteen seconds or more of running shower water are spent adjusting the water temperature to a personal level of comfort. Approximately one-half gallon of water or more can run down the shower drain, and is thereby wasted during this startup period. In addition, water may continue to run down the drain wasted while shaving, shampooing, or during any other idle time that the shower water is running. This can easily add up to multiple gallons of usable water wasted on a daily basis.

There are devices known in the prior art for saving shower water. Such devices are described in U.S. Patent Application Publication No. 2010/0051107 titled "SHOWER WATER-SAVING DEVICE", U.S. Pat. No. 5,140,714, titled "SHOWER WATER SAVER", and U.S. Pat. No. 5,165,456 titled "DIVERTER APPARATUS AND METHOD FOR SAVING FRESH WATER", all of which are incorporated herein by reference.

Such known devices do not allow for the water capturing unit to remain in the shower area while a person is showering, nor do they allow for continued capturing of shower water during other idle shower time such as shaving and shampooing. Such devices do not scoop and capture water trailing down the interior shower/tub surround-wall.

SUMMARY

One object of the present invention is to provide a highly efficient device for capturing water in a shower or bath stall. Another object of the invention is to provide a practical device that can be routinely used with a variety of different showers. Yet another object of the invention is to provide a device that can make a positive impact on water conservation. These and other objects of the invention can be achieved in various embodiments of the invention described herein.

One embodiment of the invention comprises an interior shower/tub surround-wall mounted apparatus adapted to catch and channel lead/startup and idle time shower water into a holding reservoir for repurposing. Repurposing this water can assist households with reducing water usage, because this water would otherwise go down the shower drain wasted.

Another embodiment of the invention comprises a water-saving apparatus provides a means to reduce residential shower water waste by catching open-to-touch showerhead spray water via an interior shower/tub surround-wall catch member, such as a tray, funnel or gutter, before the water contacts the shower floor during shower water startup and shower idle times, and directs the water into a holding member, such as a bucket, tank or container, so it can be later repurposed. An interior shower/tub surround-wall mounted apparatus can catch shower water before it contacts the floor, and directs it into a holding reservoir for repurposing said water thereby reducing water waste during periods a person feels or decides it is not necessary to be in contact with shower water. The apparatus makes reducing household water-waste practical, easy and convenient every time a person showers.

Another embodiment of the invention comprises a process of water conservation comprising the step of aiming a showerhead-spray toward a catch funnel during shower idle times. Portions of this water can be caught before it reaches the shower floor and funneled into a bucket or other suitable container to repurpose for a variety of uses such as watering indoor plants, prefilling clothes washing machines, and flushing toilets.

Another embodiment of the invention comprises a liquid collection apparatus comprising a collecting member adapted to collect a flow of liquid, the collecting member defining an entrance opening for receiving the flow of liquid and an exit opening for exiting the flow of liquid. A drainage member is in communication with the exit opening of the collecting member. The drainage member is adapted to receive liquid collected in the collecting member and transport the liquid to a reservoir, and at least one attachment member is connected to the collecting member and adapted to attach the collecting member to a wall surface.

Another embodiment of the invention comprises a method of water conservation comprising the steps of releasably attaching a collecting member to a surface of a wall in a shower stall. The collecting member has an entrance opening for receiving the flow of liquid and an exit opening for exiting the flow of liquid. A drainage member is releasably attached to the collecting member. The drainage member is in communication with the exit opening of the collecting member and is adapted to receive liquid collected in the collecting member and transport the liquid to a reservoir. The showerhead is positioned so that water sprayed from the showerhead contacts the wall at a location above the collecting member. The showerhead is turned on whereby water sprayed from the showerhead contacts the wall and flows into the collecting member.

Another embodiment of the invention comprises liquid collection apparatus comprising a collecting member adapted to collect a flow of liquid. The collecting member defines an entrance opening for receiving the flow of liquid, and an exit opening for exiting the flow of liquid. A drainage member communicates with the exit opening of the collecting member, and the drainage member is adapted to receive liquid collected in the collecting member and transport the liquid to a reservoir. At least one attachment member is connected to the collecting member and is adapted to attach the collecting member to a wall surface.

According to an embodiment of the invention, the exit opening of the collecting member is smaller than the entrance opening According to another embodiment of the invention, the collecting member can be a funnel, tray or gutter.

According to another embodiment of the invention, the drainage member comprises an elbow section and at least one tube section. The elbow section has a first end attached at the exit opening of the collecting member, and a second end attached to the at least one tube section.

According to another embodiment of the invention, the drainage member can be comprised of one, two or three tube sections.

According to another embodiment of the invention, a user can utilize as many tube sections as necessary so that the drainage member extends from the collecting member to the reservoir.

According to another embodiment of the invention, the elbow section is pivotable about the exit opening of the collecting member.

According to another embodiment of the invention, the elbow section is attached to the collecting member by frictional engagement.

According to another embodiment of the invention, the elbow section is frictionally engaged to the drainage member.

According to another embodiment of the invention, the apparatus further comprises a sealing member connected to the collecting member proximate the entrance opening, the sealing member adapted to form a seal between the collecting member and the wall surface.

According to another embodiment of the invention, the sealing member comprises a gasket extending upwardly from a top edge of the collecting member.

According to another embodiment of the invention, the collecting member includes a retaining member, and the gasket is positioned within the retaining member.

According to another embodiment of the invention, the attachment member comprises first and second sections of hook and loop fasteners positioned on the collecting member.

According to another embodiment of the invention, the apparatus further comprises a reservoir, such as a bucket, tank, or container.

Another embodiment of the invention comprises a liquid collection kit comprising a collecting member adapted to collect a flow of liquid. The collecting member has an entrance opening for receiving the flow of liquid and an exit opening through which the liquid exits. A drainage member communicates with the exit opening of the collecting member. The drainage member receives liquid collected in the collecting member and transports the liquid to a reservoir. The kit further includes means for releasably attaching the collecting member to a wall surface.

According to another embodiment of the invention, the means for releasably attaching the collecting member to a wall surface comprises hook and loop fasteners.

According to another embodiment of the invention, the kit includes a reservoir, such as a bucket, tank or container.

According to another embodiment of the invention, the drainage member comprises an elbow section and a first tube section releasably attached to a second tube section, the elbow section having a first end releasably attached at the exit opening of the collecting member and a second end releasably attached to the first tube section.

Another embodiment of the invention comprises a method of water conservation comprising the steps of providing a collecting member defining an entrance opening for receiving the flow of liquid and an exit opening for exiting the flow of liquid, and releasably attaching a drainage member to the collecting member. The drainage member is in communication with the exit opening of the collecting member and is adapted to receive liquid collected in the collecting member and transport the liquid to a reservoir. The collecting member is releasably attached to a surface of a wall in a shower stall having a showerhead that sprays water. The showerhead is positioned so that water sprayed from the showerhead contacts the wall at a location above the collecting member. The showerhead is turned on and sprays water at the wall. The water hits the wall and flows downward into the collecting member. Water in the collecting member flows into the drainage member, which leads the water to a reservoir.

According to another embodiment of the invention, a plurality of hook fasteners can be attached to the collecting member and a plurality of complementary loop fasteners can be attached to the wall, whereby the collecting member is releasably attached to the wall.

According to another embodiment of the invention, a plurality of loop fasteners can be attached to the collecting member and a plurality of complementary hook fasteners can be attached to the wall, whereby the collecting member is releasably attached to the wall.

DETAILED DESCRIPTION OF PREFERRED EMBODIMENTS

Figure 1:
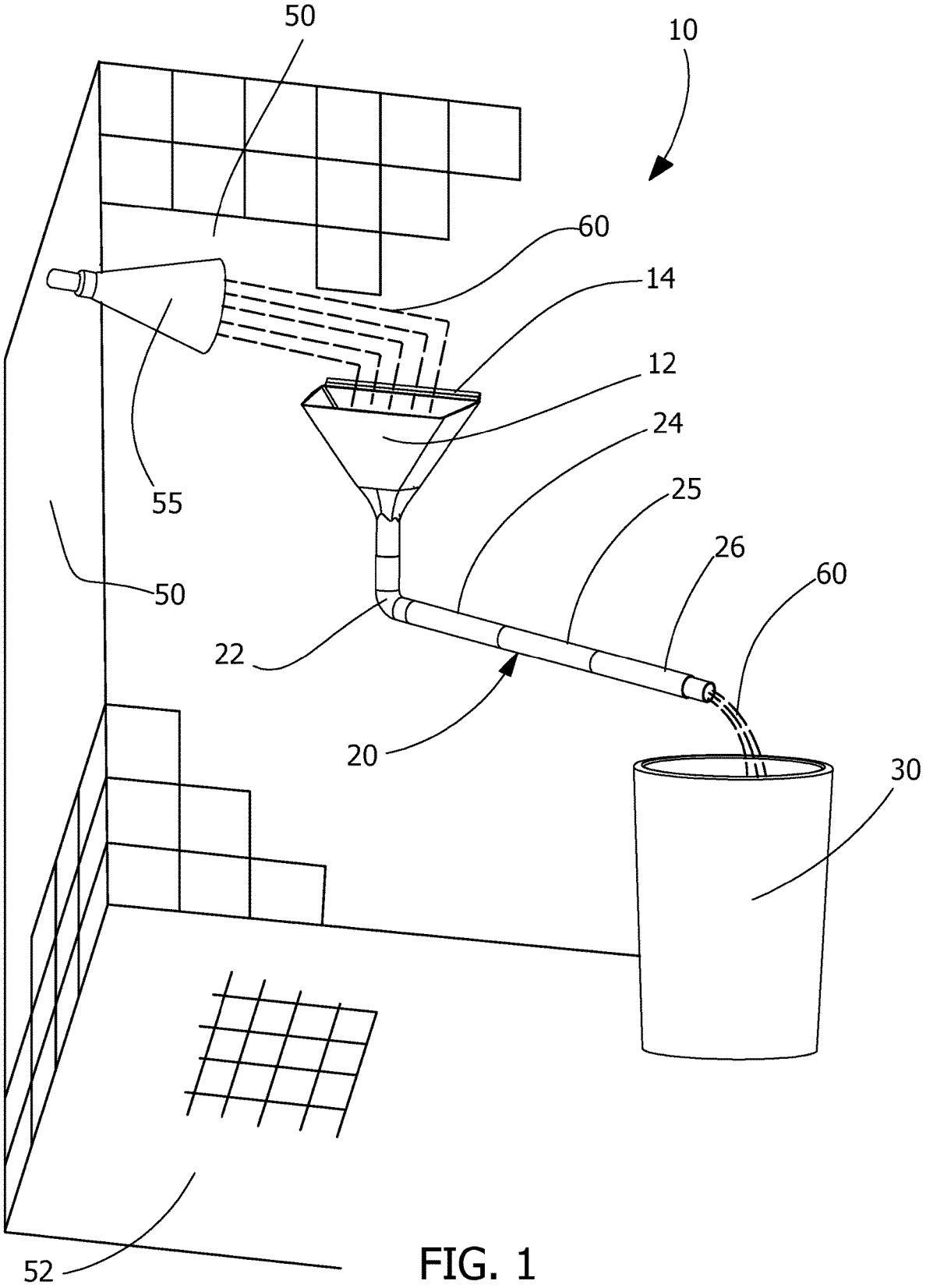
FIG. 1 is an environmental perspective view of a shower water collection apparatus according to an embodiment of the invention.

A shower water collection apparatus according to a preferred embodiment of the invention is illustrated in FIGS. 1-10, and shown generally at reference numeral 10. The apparatus 10 comprises a collecting member 12 that can capture water or other liquid in communication with a drainage member 20 adapted for transporting the water to a reservoir 30.

Figure 2:
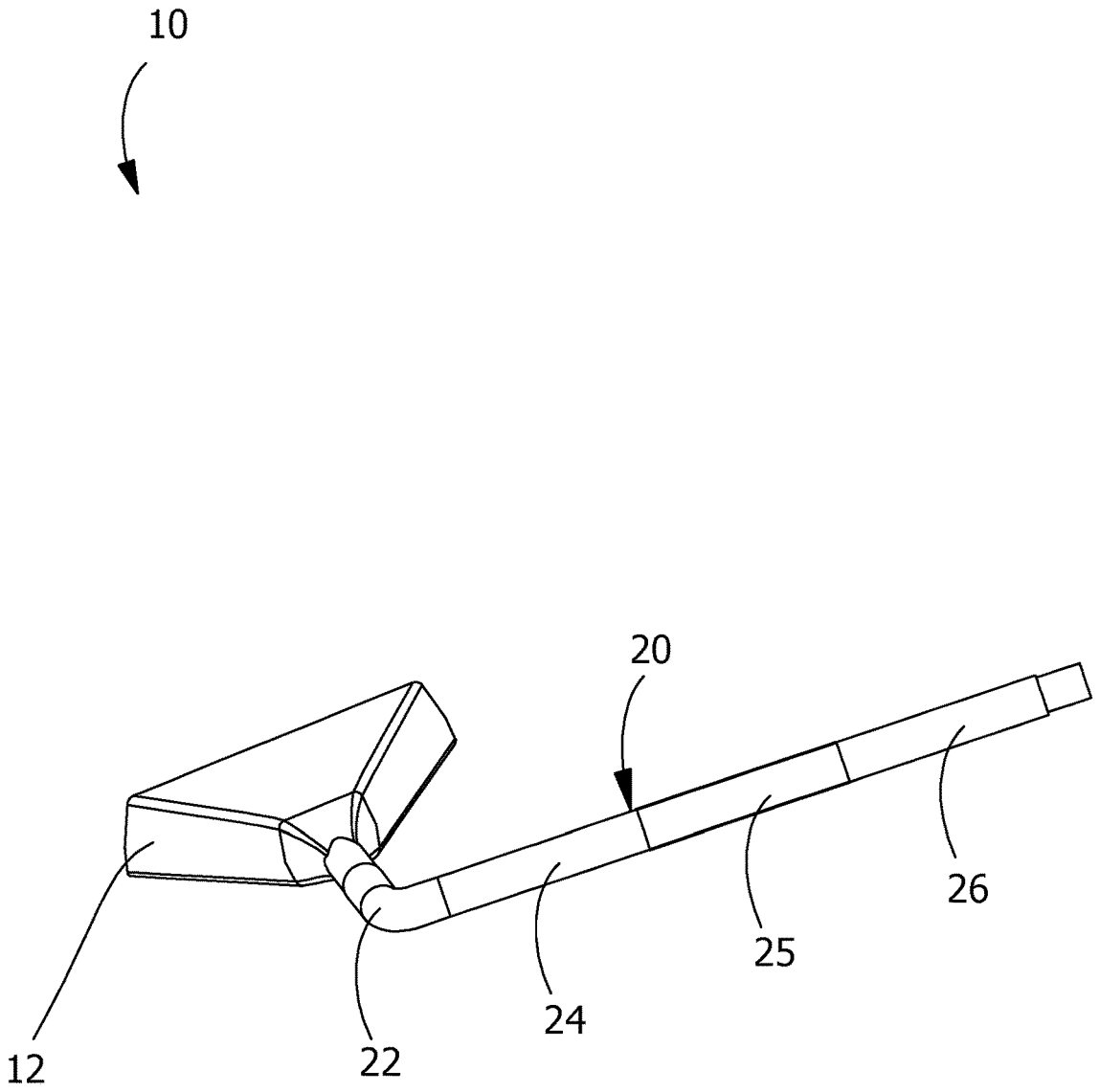
FIG. 2 is a perspective view of the apparatus of FIG. 1.
Figure 3:
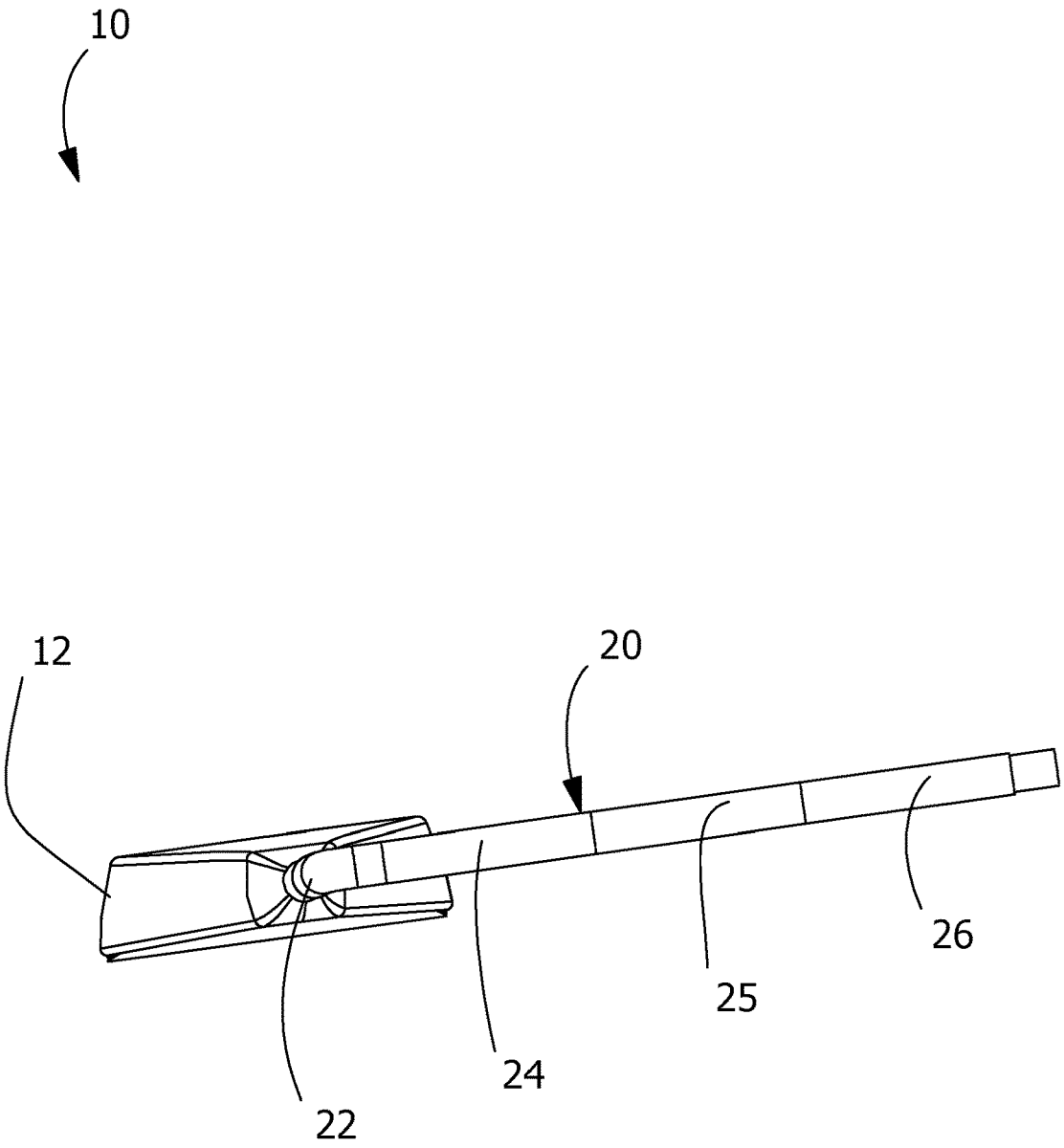
FIG. 3 is another perspective view of the apparatus of FIG. 1.
Figure 4:
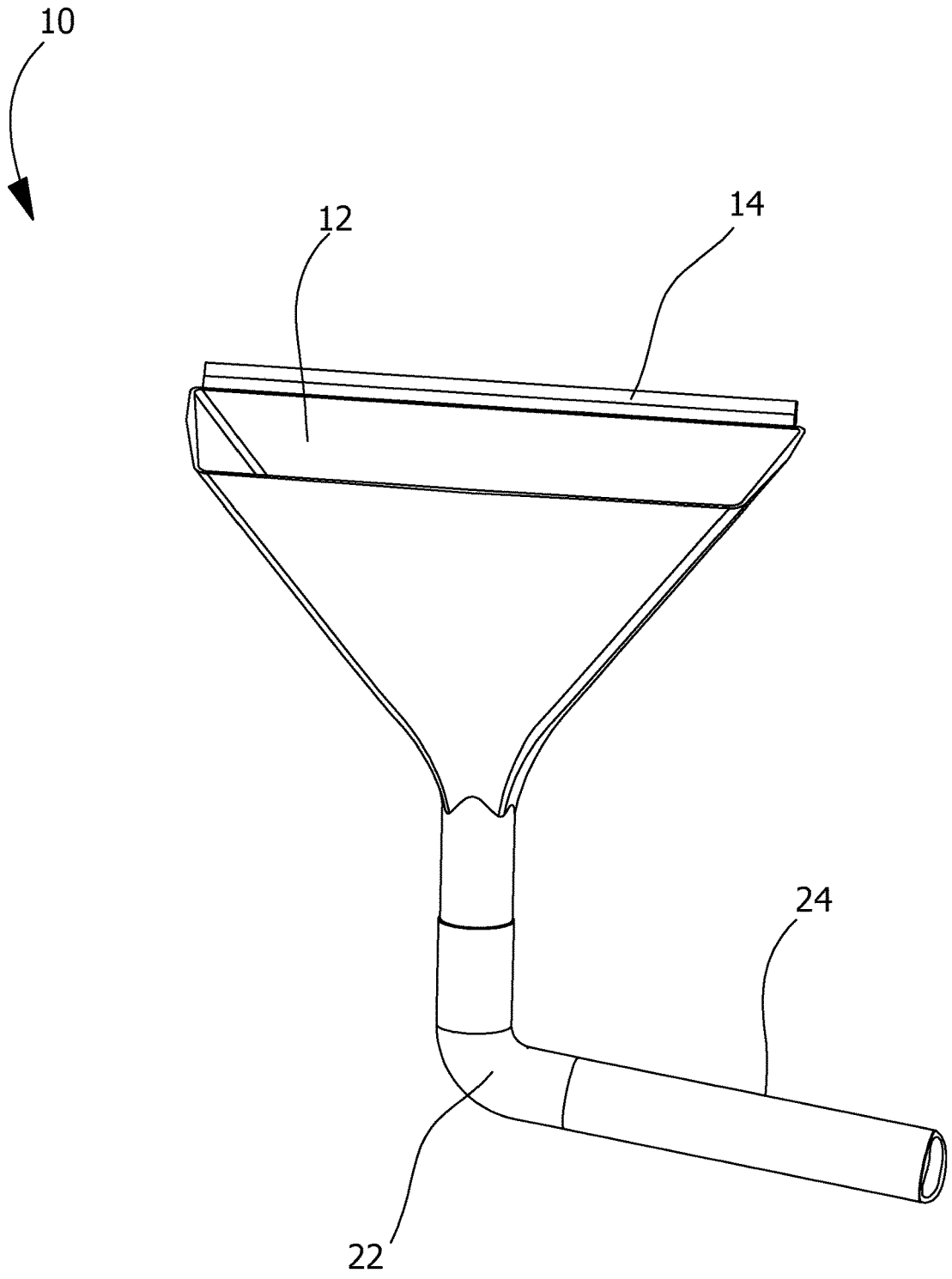
FIG. 4 is another perspective view of the apparatus of FIG. 1.
Figure 8:
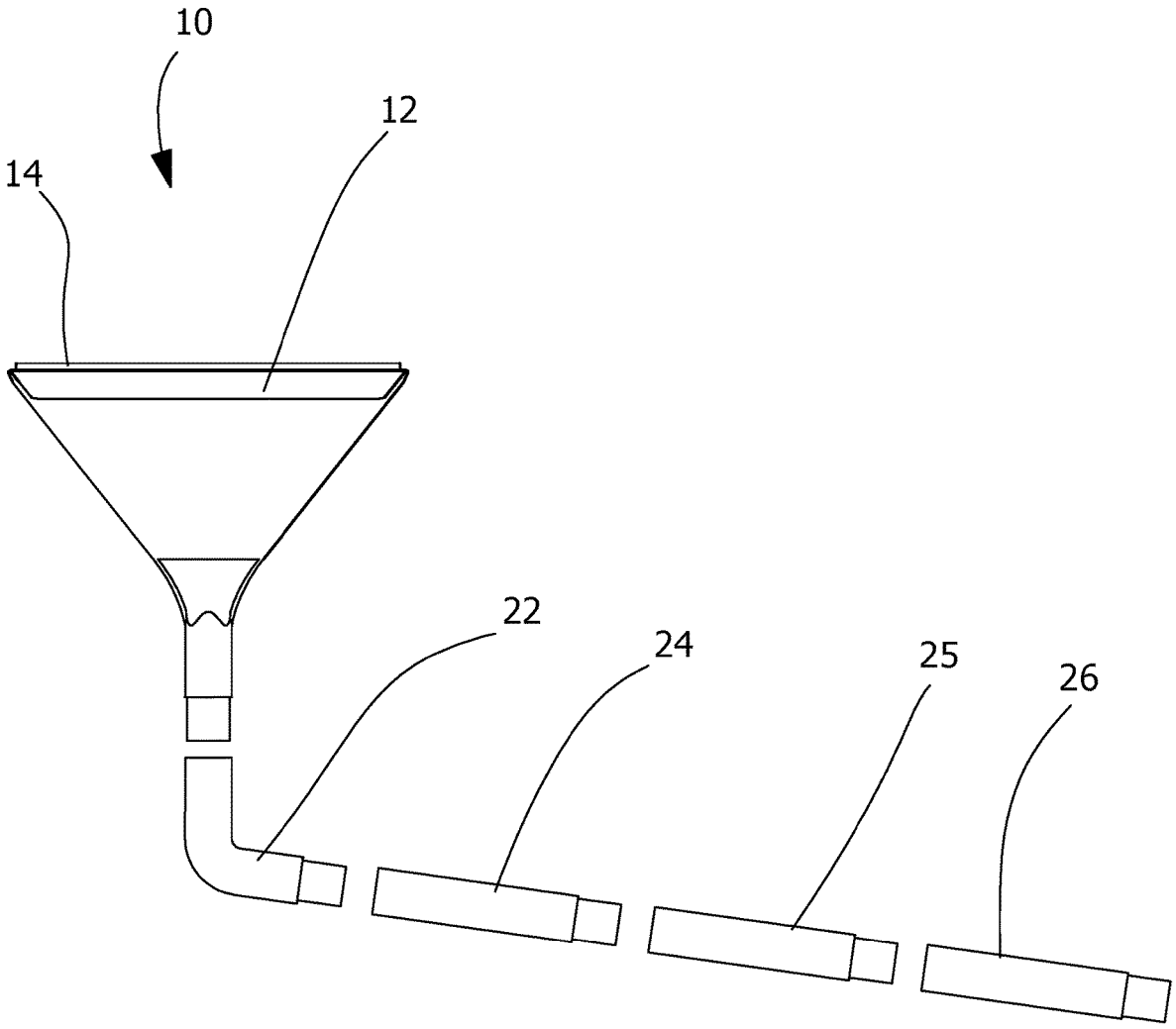
FIG. 8 is an exploded perspective view of the apparatus of FIG. 1.
Figure 9:
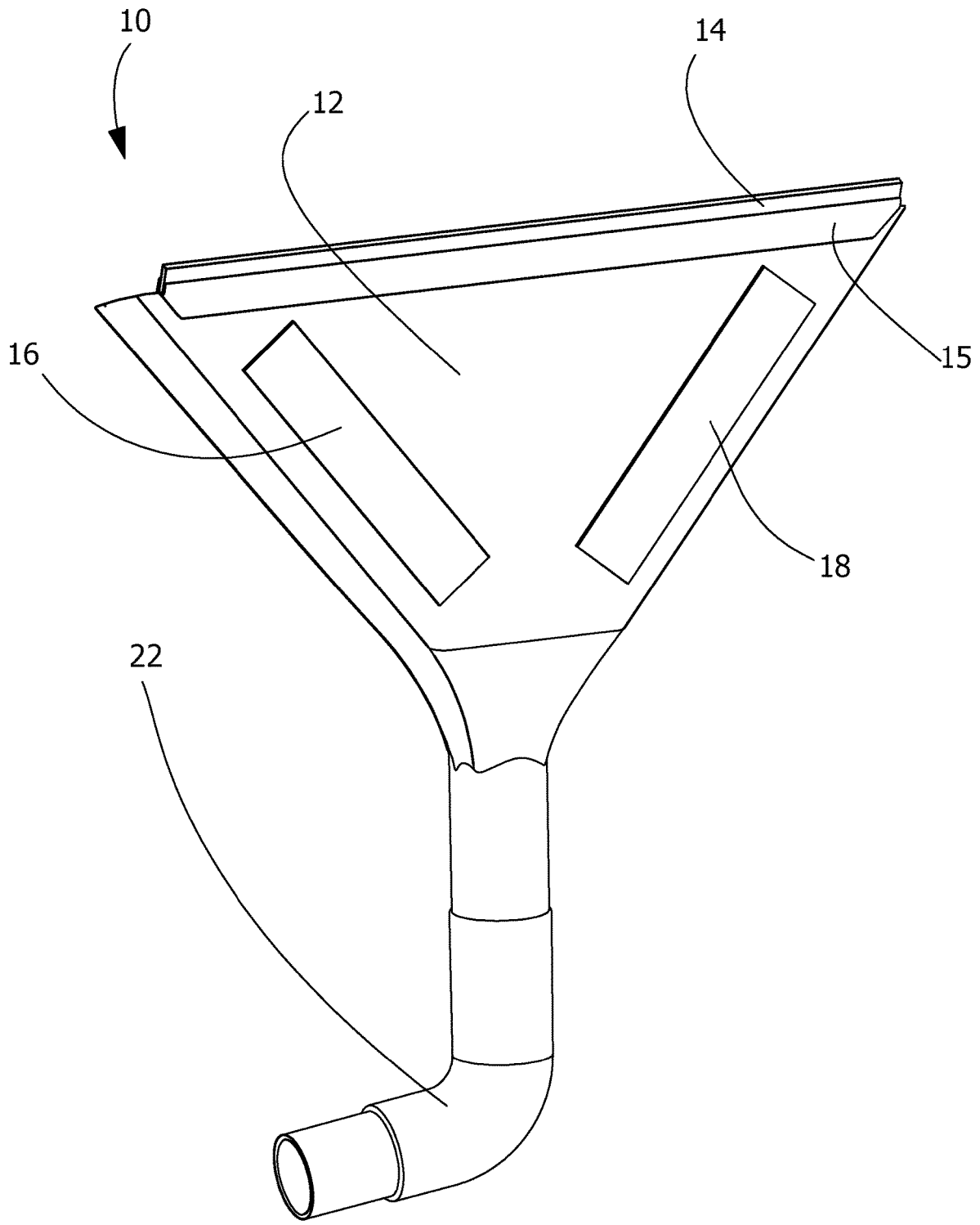
FIG. 9 is another perspective view of the apparatus of FIG. 1.

The collecting section 12 can be comprised of a funnel, as shown in FIGS. 8 and 9. Alternatively, the collecting section 12 can be a tray or gutter. The drainage member 20 can comprise a hollow drain tube, as shown in FIGS. 1-3. The drainage member 20 can be comprised of a centered 1¼ drain and 82 degree/98 degree drain push-on, friction-hold tube elbow 22 and push-on, friction-hold drain tube sections 24, 25, 26. The push-on, friction-hold drain tube sections 24, 25, 26 and the push-on, friction-hold tube elbow 22 are connected to each other by frictional engagement. As shown in FIG. 8, the elbow has a connecting union that is shaped and sized to be received in and frictionally engage tube section 24. Likewise, tube section 24 has a connecting union that is received in and frictionally engages tube section 25, and tube section 25 has a connecting union that is received in and frictionally engages tube section 26. If the drainage tube 20 needs to be longer, an additional tube union can be added at tube union 26, and additional tube unions can be added beyond that if necessary. If the user desires a shorter drainage tube 20, tube section 26 and/or tube section 25 can be omitted.

Figure 10:
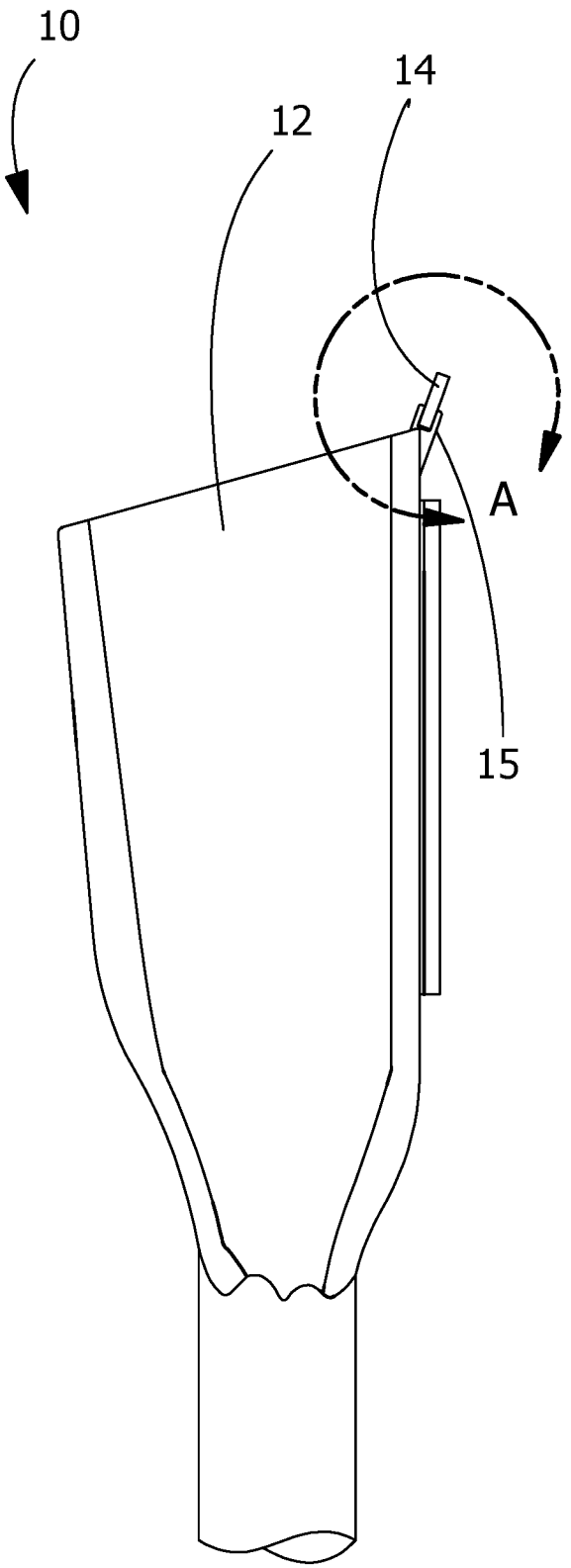
FIG. 10 is a side view of the apparatus of FIG. 1.
Figure 10A:
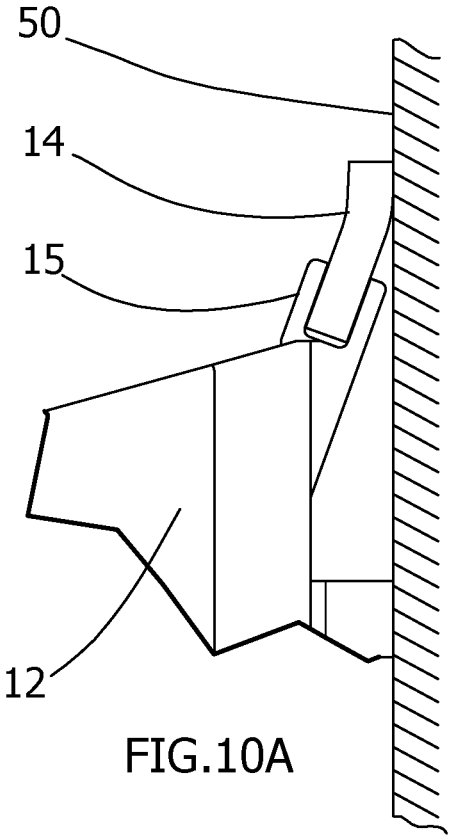
FIG. 10A is an enlarged partial side view of the apparatus of FIG. 1, taken along line A of FIG. 9.

The apparatus 10 can include a sealing member 14 such as a gasket extending upwardly at a slight angle from a top edge of the funnel 12, as shown in FIGS. 4, 9, 10 and 10A. The apparatus 10 can include a retaining member 15 positioned at the top edge of the funnel 12 for holding the gasket 14. The retaining member 15 defines a recess that receives and frictionally engages the gasket 14, as shown in FIGS. 9, 10 and 10A.

Figure 5:
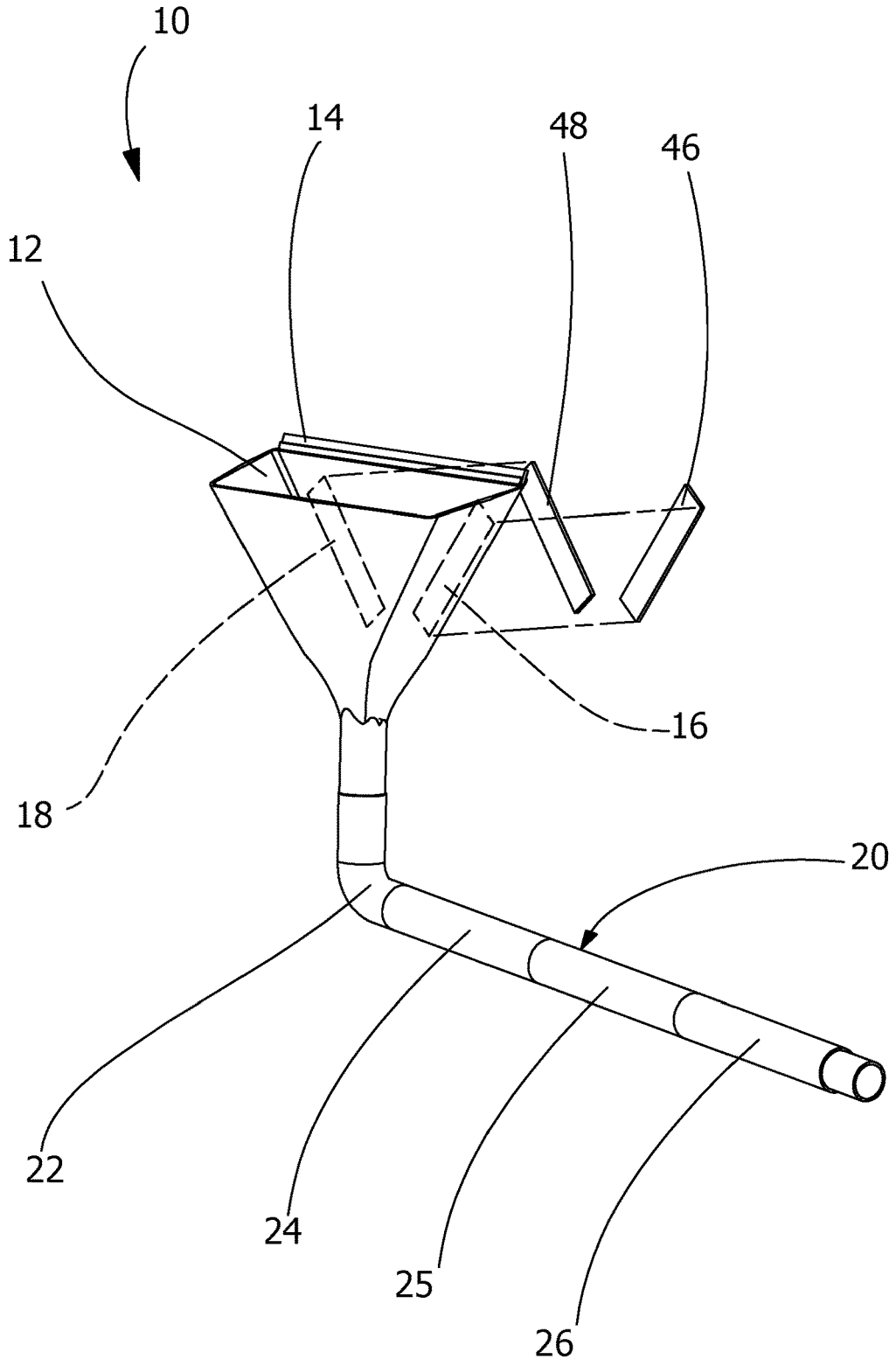
FIG. 5 is an exploded perspective view of the apparatus of FIG. 1.
Figure 6:
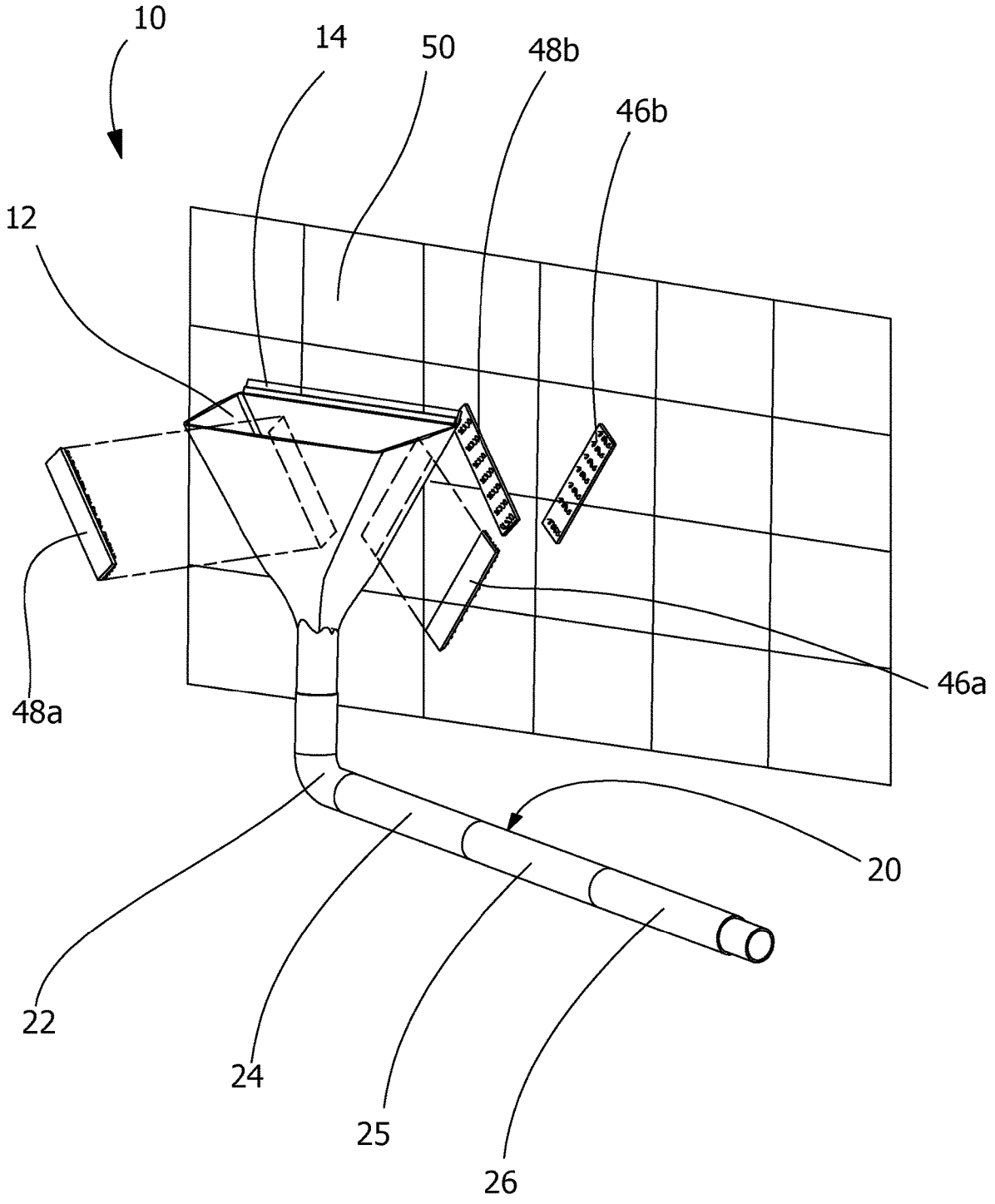
FIG. 6 is an exploded environmental view of the apparatus of FIG. 1.
Figure 7:
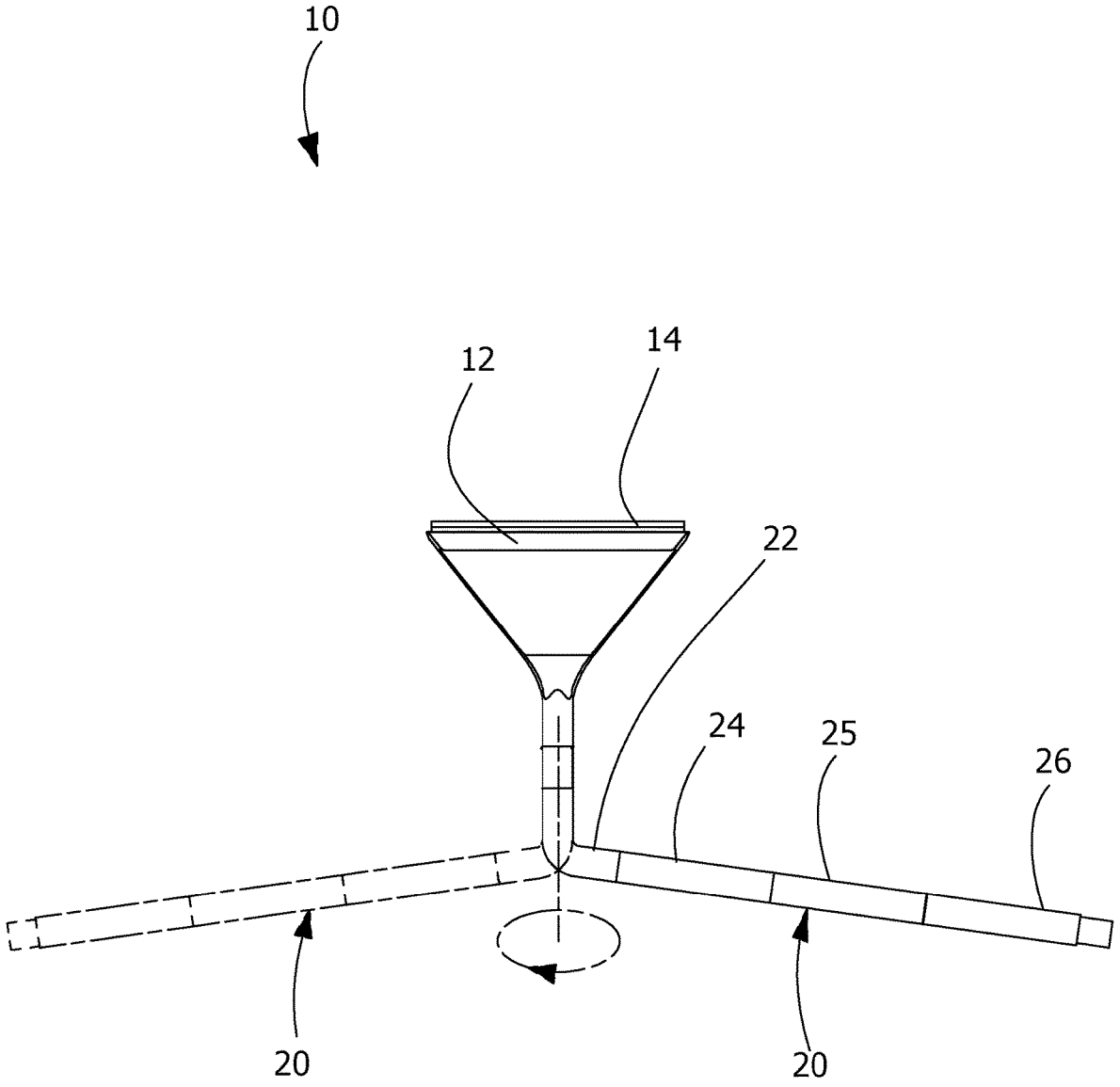
FIG. 7 is another perspective view of the apparatus of FIG. 1.

The apparatus 10 can be part of a kit that includes means for releasably attaching the funnel 12 to a surface, such as the interior surface of a shower stall or bathtub. As shown in FIGS. 1, 5, and 6, the apparatus 10 can be attached to the interior surround-wall 50 of a shower stall using double-sided self-adhesive hook and loop (VELCRO) tape sections 46, 48. Preferably, each hook and loop tape section 46, 48 is comprised of a section of hook fasteners 46*a*, 48*a*, respectively, engaging a section of loop fasteners 46*b*, 48*b*, respectively. An adhesive, such as glue is positioned on the outer surfaces of the tape sections 46, 48 (i.e., sides opposed to the hook and loop fasteners), and a peelable protective film can cover the adhesive.

There can be slightly raised rectangular sections 16, 18 formed on the outer surface of back side of the funnel 12 on which to position the double-sided hook and loop sections 46, 48, as shown in FIGS. 5 and 9. One side of each hook and loop tape section 46, 48 is adhered to the raised sections 16, 18, respectively, and the opposite side of each hook and loop tape section 46, 48 can be adhered to the wall 50. For example, the peelable film sheets on the hook fastener sections 46*a*, 48*a* can be removed to expose the adhesive, and the hook and loop tape sections 46, 48 can be adhered to the raised rectangular sections 16, 18 on the funnel 12. Then the peelable film on the outer surface of the loop fastener sections 46*b*, 48*b* can be removed and the hook and loop tape sections 46, 48 can be adhered to the shower wall 50, thereby releasably attaching the apparatus 10 to the wall 50, as shown in FIG. 1. The apparatus 10 can be easily removed from the wall 50 when desired by disengaging the hook fastener sections 46*a*, 48*a* from the loop fastener sections 46*b* 48*b*, respectively, from each other, as shown in FIG. 6. The loop fastener sections 46*b*, 48*b* can remain adhered to the shower wall 50. As such, the apparatus 10 can be easily re-attached to the wall 50 when desired by positioning the funnel 12 such that the hook fastener sections 46*a*, 48*a*, which are adhered to the funnel 12, engage the loop fastener sections 46*b* 48*b*, respectively, which are adhered to the shower wall 50. Alternatively, the loop fastener sections 46*b*, 48*b* can be adhered to the funnel 12, and the hook fastener sections 46*a*, 48*a* can be adhered to the shower wall 50.

In an alternative embodiment, the funnel 12 can be attached to the shower wall 50 with double-sided adhesive tape. One side of the tape can be attached to the funnel 12, and the other side can be attached to the wall 50.

The drainage member 20 channels and directs captured water 60 into the reservoir 30, as shown in FIG. 1. The reservoir 30 can be a bucket, tank or other suitable container. Preferably, the reservoir 30 has a capacity of approximately ten quarts.

In a method of using the apparatus 10 according to a preferred embodiment of the invention, the apparatus 10 can be used to conserve water in a shower having a movable showerhead 55. The apparatus 10 is attached to the interior surface 50 of a shower stall wall 50, as shown in FIG. 1. The user determines the best mounting spot for obtaining optimum performance and results. With the shower water turned on, the user turns the showerhead 55 by hand as sharply as possible toward the interior shower/tub wall 50. The aim of the showerhead-spray is positioned to the highest and closest point possible on the wall 50. The center point of where the largest volume of water trails down the wall 50 is located and the user places his finger on this spot. The user turns the water off and marks this location with a small piece of tape or dry erase marker.

Preferably, the surface area just below the tape mark is cleaned using an alcohol wipe. Next, the outer protective film on the double-sided hook and loop tape sections 46, 48 can be removed to expose adhesive on the outer surfaces of the hook and loop tape sections 46, 48. One side of the hook and loop tape sections 46, 48 are positioned on the raised sections 16, 18, respectively, of the funnel 12, and the opposite side of the hook and loop tape sections 46, 48 are positioned on the wall 50. For example, the hook fastener sections 46*a*, 48*a* can be adhered to the funnel 12, and the loop fastener sections 46*b*, 48*b* can be adhered to the wall 50. Preferably, the funnel 12 is attached to the wall 50 by positioning the tape sections 46, 48 against the wall 50 such that the funnel 12 is level, centered and approximately six inches below the wall spot previously marked with tape or maker. Preferably, the apparatus 10 is positioned at a low height relative to the floor 52 of the shower stall, as shown in FIG. 1. The funnel 12 is pressed firmly against the shower wall 50 surface continuing to hold pressure for approximately thirty seconds. After allowing the adhesive on the loop fastener sections 46*b*, 48*b* to cure for approximately one hour, the drain elbow 22 is pushed firmly onto the funnel drain exit 19, and its outlet is aimed toward the rear of the shower. One, two or three of the straight drain tube extensions 24, 25, 26 can be utilized by pushing firmly the tube sections 24, 25, 26 together to achieve the length needed to reach the rear area of the shower. As shown in FIG. 6, the elbow 22 can be pivoted 360 degrees about the funnel drain exit 19 so that the drain tube 20 can extend in different directions to adapt to various showers having showerheads positioned at different locations.

The user aims the shower head 55 so that water strikes the wall 50 of the shower stall and flows downward into the funnel 12, as shown in FIG. 1. The user turns on the shower water and the apparatus 10 captures shower water flowing down the wall 50 and into the funnel 12. The showerhead 55 is aimed at the interior shower/tub surround-wall 50, and collects water 60 trailing down the wall 50. As shown in FIG. 9A, the sealing member 14 of the funnel 12 is pushed against the wall 50, creating a seal on the wall surface 50 that facilitates collection of the water 60 flowing down the wall 50. The sealing member 14 can be made of a resilient, bendable material, such as rubber, that can bend when pushed against the wall 50, as shown in FIG. 9A. Water 60 flowing down the wall 50 flows into the funnel 12. The water collected in the funnel 12 flows through the funnel 12 and into the drainage member 20, which empties the water into the reservoir 30. The apparatus 10 remains in the shower stall while a person is showering, and the shower spray 60 remains open to the touch even while directed to the interior shower/tub surround-wall mounted catch tray 12, allowing for continued capturing of shower water 60 during other idle shower times such as shaving and shampooing.

As shown in FIG. 10A, the sealing member 14 fits closely to the wall like a seal creating a scoop effect to capture water trailing down the wall 50, making the apparatus 10 very efficient at catching water. The seal between the wall 50 and the funnel 12 directs water 60 trailing down the shower wall 50 into the apparatus 10 rather than bypassing through a gap between the backside of the funnel 12 and shower wall 50.

The apparatus 10 is mounted on the shower wall 50, allowing for hands free operation. The apparatus 10 is releasably attached to the shower wall 50 by hook and loop fasteners and as such can be easily removed when desired.

The apparatus 10 demonstrates the functionality to catch the beginning/lead shower water and channel it into a holding reservoir 30 that is placed out of the shower user's way, since the apparatus is mounted on the interior shower/tub surround-wall. The showerhead spray can be caught while at an angle rather than straight on which also allows the shower user to shave and shampoo without blocking the showerhead water spray to be caught for repurposing.

The showerhead water spray pattern remains open to touch while being caught by the apparatus 10, allowing the user to feel and adjust the water temperature to a personal level of comfort before aiming the shower head toward themselves to shower. The apparatus 10 catches water while the showerhead 55 is aimed at an angle allowing the shower user to remain in the stall during use without blocking spray or water capturing ability.

A shower water collection apparatus and method of using same are described above. Various changes can be made to the invention without departing from its scope. The above description of embodiments of the invention are provided for the purpose of illustration only and not limitation—the invention being defined by the claims and equivalents thereof.

What is claimed is:

1. A liquid collection apparatus comprising:

(a) a collecting member adapted to collect a flow of liquid, the collecting member defining an entrance opening for receiving the flow of liquid and an exit opening for exiting the flow of liquid;

(b) a drainage member communicating with the exit opening of the collecting member, the drainage member adapted to receive liquid collected in the collecting member and transport the liquid to a reservoir;

(c) at least one attachment member connected to the collecting member and adapted to attach the collecting member to a wall surface; and (d) a sealing member connected to the collecting member proximate the entrance opening and extending upwardly from a top edge of the collecting member at an obtuse angle relative to the collecting member, the sealing member adapted to form a seal between the collecting member and the wall surface.

2. The apparatus according to claim 1, wherein the exit opening of the collecting member is smaller than the entrance opening.

3. The apparatus according to claim 1, wherein the collecting member comprises at least one selected from the group consisting of a funnel, tray and gutter.

4. The apparatus according to claim 1, wherein the drainage member comprises an elbow section and at least one tube section, the elbow section having a first end attached at the exit opening of the collecting member and a second end attached to the at least one tube section.

5. The apparatus according to claim 4, wherein the at least one tube section comprises first, second and third tube sections.

6. The apparatus according to claim 4, wherein the elbow section is pivotable about the exit opening of the collecting member.

7. The apparatus according to claim 4, wherein the elbow section is attached to the collecting member by frictional engagement.

8. The apparatus according to claim 4, wherein the elbow section is frictionally engaged to the at least one tube section.

9. The apparatus according to claim 1, wherein the sealing member is adapted to form a seal between the collecting member and the wall surface without being attached to the wall surface.

10. The apparatus according to claim 9, wherein the sealing member comprises a gasket comprising a resilient, bendable material.

11. The apparatus according to claim 10, wherein the collecting member includes a retaining member, and the gasket is positioned within the retaining member.

12. The apparatus according to claim 1, wherein the at least one attachment member comprises first and second sections of hook and loop fasteners positioned on the collecting member.

13. A liquid collection kit comprising:

(a) a collecting member adapted to collect a flow of liquid, the collecting member defining an entrance opening for receiving the flow of liquid and an exit opening for exiting the flow of liquid;

(b) a drainage member communicating with the exit opening of the collecting member, the drainage member adapted to receive liquid collected in the collecting member and transport the liquid to a reservoir; and (c) means for releasably attaching the collecting member to a wall surface; and (d) a sealing member connected to the collecting member proximate the entrance opening and extending upwardly from a top edge of the collecting member at an obtuse angle relative to the collecting member, the sealing member adapted to form a seal between the collecting member and the wall surface.

14. The kit according to claim 13, wherein the means for releasably attaching the collecting member to a wall surface comprises hook and loop fasteners.

15. The kit according to claim 13, further comprising a reservoir selected from the group consisting of a bucket, tank, and container.

16. The kit according to claim 13, wherein the drainage member comprises an elbow section and a first tube section releasably attached to a second tube section, the elbow section having a first end releasably attached at the exit opening of the collecting member and a second end releasably attached to the first tube section.

17. The kit according to claim 13, wherein the sealing member comprises a rubber gasket.

18. The kit according to claim 13, wherein the means for releasably attaching the collecting member to a wall surface comprises a plurality of hook fasteners attached to the collecting member and a plurality of loop fasteners adapted for attachment to the wall surface.

19. A liquid collection apparatus comprising:

(a) a collecting member adapted to collect a flow of liquid, the collecting member defining an entrance opening for receiving the flow of liquid and an exit opening for exiting the flow of liquid;

(b) a drainage member communicating with the exit opening of the collecting member, the drainage member adapted to receive liquid collected in the collecting member and transport the liquid to a reservoir; and (c) at least one attachment member connected to the collecting member and adapted to attach the collecting member to a wall surface;

(d) a sealing member connected to the collecting member proximate the entrance opening, the sealing member adapted to form a seal between the collecting member and the wall surface, the sealing member comprising a gasket extending upwardly from a top edge of the collecting member; and (e) wherein the collecting member includes a retaining member, and the gasket is positioned within the retaining member.

20. The apparatus according to claim 19, wherein the retaining member defines a recess that receives and frictionally engages the gasket.

* * * * *